US009415903B2

(12) United States Patent
Albisetti

(10) Patent No.: US 9,415,903 B2
(45) Date of Patent: Aug. 16, 2016

(54) PRODUCT DISPENSING HEAD FOR A CONTAINER AND ASSOCIATED DISPENSING DEVICE

(75) Inventor: Nicolas Albisetti, Saint Gratien (FR)

(73) Assignee: L'Oreal, Paris (FR)

( * ) Notice: Subject to any disclaimer, the term of this patent is extended or adjusted under 35 U.S.C. 154(b) by 247 days.

(21) Appl. No.: 14/238,618

(22) PCT Filed: Aug. 13, 2012

(86) PCT No.: PCT/EP2012/065811
§ 371 (c)(1),
(2), (4) Date: May 22, 2014

(87) PCT Pub. No.: WO2013/024069
PCT Pub. Date: Feb. 21, 2013

(65) Prior Publication Data

US 2014/0286690 A1 Sep. 25, 2014

Related U.S. Application Data

(60) Provisional application No. 61/554,092, filed on Nov. 1, 2011.

(30) Foreign Application Priority Data

Aug. 16, 2011 (FR) ..... 11 57348

(51) Int. Cl.

| | |
|---|---|
| ***B65D 35/36*** | (2006.01) |
| ***B65D 47/20*** | (2006.01) |
| ***B65D 47/42*** | (2006.01) |
| ***A45D 19/02*** | (2006.01) |

(52) U.S. Cl.
CPC ..... *B65D 35/36* (2013.01); *A45D 19/02* (2013.01); *B65D 47/2037* (2013.01); *B65D 47/42* (2013.01)

(58) Field of Classification Search
CPC combination set(s) only.
See application file for complete search history.

(56) References Cited

U.S. PATENT DOCUMENTS

| | | | |
|---|---|---|---|
| 2,013,166 | A | 9/1935 | Mitchell |
| 2,188,191 | A | 1/1940 | Roos |
| 2,283,463 | A | 5/1942 | Rupp |
| 5,727,893 | A | 3/1998 | Handler |
| 5,730,337 | A | 3/1998 | Carlile, Jr. et al. |

(Continued)

FOREIGN PATENT DOCUMENTS

| | | | |
|---|---|---|---|
| EP | 0410857 | A1 | 1/1991 |
| EP | 0430724 | A1 | 6/1991 |

(Continued)

*Primary Examiner* — David Walczak
(74) *Attorney, Agent, or Firm* — Polsinelli PC

(57) ABSTRACT

The head (16) includes an application wall (30) having a central axis (A-A'), in which the application wall (30) defines at least one product dispensing orifice (82A), off-centered with respect to the central axis (A-A'), It includes a removable cap, mobile between a position for closing each dispensing orifice (82A) and a product dispensing position, the removable cap (32) comprising a bearing element (106B) on the application wall (30). The dispensing orifice (82A) remains clear when the bearing element is applied on the application wall (30), When the cap (32) occupies its closing position, each dispensing orifice (82A) is placed facing an intermediate closed region (154) of a bearing element (106B), located between a first exterior contact region (152A) of the bearing element (106B) with the application wall (30) and a second interior contact region (152B) of the bearing element (106B) with the application wall (30).

20 Claims, 10 Drawing Sheets

(56) References Cited

U.S. PATENT DOCUMENTS

| | | | | |
|---|---|---|---|---|
| 6,270,277 | B1 * | 8/2001 | Ogino | A46B 11/0013 401/262 |
| 6,688,795 | B1 * | 2/2004 | Jacob | A45D 34/04 401/202 |
| 7,740,155 | B1 | 6/2010 | Gallegos | |
| 2002/0148802 | A1 | 10/2002 | Takahashi et al. | |
| 2006/0140707 | A1 | 6/2006 | Ducroquet | |
| 2007/0098484 | A1 * | 5/2007 | Dieudonat | A45D 34/02 401/263 |
| 2007/0295763 | A1 | 12/2007 | Brunner et al. | |

FOREIGN PATENT DOCUMENTS

| | | | |
|---|---|---|---|
| FR | 1035103 | A | 8/1953 |
| FR | 2630409 | A3 | 10/1989 |
| FR | 2860769 | A1 | 4/2005 |
| FR | 2954937 | A1 | 7/2011 |

* cited by examiner

PRODUCT DISPENSING HEAD FOR A CONTAINER AND ASSOCIATED DISPENSING DEVICE

CROSS REFERENCE TO RELATED APPLICATIONS

This application is a National Phase filing under 35 U.S.C. §371 of PCT/EP2012/065811 filed on Aug. 13, 2012; and this application claims priority to Application No. 1157348 filed in France on Aug. 16, 2011; and this application claims the benefit of U.S. Provisional Application No. 61/554,092 filed on Nov. 1, 2011; the entire contents of all are hereby incorporated by reference.

This invention relates to a product dispensing head for a container including:

- an application wall having a central axis, in which the application wall defines at least one product dispensing orifice, off-centered with respect to the central axis,
- a removable cap, mobile with respect to the application wall between a position for closing each dispensing orifice and a product dispensing position, the removable cap comprising a bearing element on the application wall, suitable for exerting a pressure on the application wall at a distance from the dispensing orifice when the cap occupies its closing position, in which the dispensing orifice remains clear when the bearing element is applied on the application wall.

This dispensing head is intended to be mounted on a container containing a cosmetic product, for storage, then for dispensing and applying the cosmetic product on a keratin surface of a user, such as the skin or the hair.

In particular for the meaning of this invention, "cosmetic product", means a product as defined in Directive 93/35/EEC of Jun. 14, 1993, or in Regulation No. 1223/2009 of the European Parliament and the Council dated Nov. 30, 2009.

This cosmetic product is in particular a liquid, gel, creamy or pasty product, such as a product for care, maintenance or coloring of the skin or hair, or a body hygiene product, such as, in particular, a deodorant.

To store cosmetic products capable of being poured, it is known to use a tube-shaped container equipped at its end with a product dispensing head.

The head has at least one product-dispensing orifice that opens onto an application surface.

To extract the product from the container, pressure is exerted on the product so as to push the product out of the container through the dispensing orifice. The product is then collected before being applied on the keratin surface.

When the dispensing device is not used, the application surface is generally capped with a closing cap, so as to prevent the product from flowing out of the tube during storage. The cap also prevents degradation or contamination of the product.

The cap includes, for example, a peripheral skirt applied around the application surface so as to close the container.

To improve the seal of the device, it is known to use caps equipped with an interior skirt applied directly on the application surface around the dispensing orifice.

FR 2 534 885 describes an application head of the type mentioned above. The interior skirt of the rigid cap is applied on the rigid application surface defining the dispensing orifice.

To ensure a good seal, it is therefore necessary to provide very precise production clearances so as to prevent the product from leaking after the cap has been screwed onto the application head.

To overcome this problem, FR 2 736 623 describes a solution in which a deformable membrane covers, at rest, the dispensing orifices. The membrane is deformed by the pressure of the product when it is extracted from the tube. This deformation frees the product dispensing orifices. A closing cap having a central projection is applied on the membrane, without exerting pressure on it.

FR 2 779 416, EP 0 096 102, and U.S. Pat. No. 5,678,731 describe other product dispensing heads. FR 2 919 176 describes a product application device including curved application fingers.

In all of these documents, the seal of the container when it is not used, in particular when the device is stored upside down, may still be improved.

An objective of the invention is therefore to obtain a product application head comprising an application wall and a cap capping the application wall, in which the seal is improved for storage, in particular for upside-down storage.

To this end, the invention relates to a dispensing head of the type mentioned above, characterized in that, when the cap occupies its closing position, each dispensing orifice is placed facing an intermediate closed region of a bearing element, located between a first exterior contact region of the bearing element with the application wall and a second interior contact region of the bearing element with the application wall.

The dispensing head according to the invention may include one or more of the following features, considered alone or in any combination that is technically possible:

- at least one of the first region and the second region revolves about the central axis;
- the first region and the second region are connected to one another by intermediate contact regions of a bearing element on the application wall, in which the first region, each intermediate contact region and the second region define a closed contact line surrounding a dispensing orifice;
- the first region and the second region are formed by contact lines, with the radial span of each region being less than 4 mm, advantageously being comprised between 0.2 mm and 2 mm;
- the dispensing orifice is formed by an slot, with a maximum radial span less than its length;
- the maximum radial distance radially separating the dispensing orifice from the first region and the second region is less or equal to 5 mm, and is advantageously comprised between 0.25 mm and 5 mm;
- the maximum radial distance separating the first region from the second region is greater than 0.5 mm, and is advantageously less than 10 mm, and is in particular comprised between 0.5 mm and 10 mm, advantageously between 2 mm and 5 mm;
- the application wall has a central area without an orifice delimited externally by the second region and through which the central axis passes;
- the application wall has a downstream surface without roughnesses or macroscopic projections;
- each bearing element is more rigid than the application wall, with the application wall being locally deformable in the vicinity of the dispensing orifice, one each side of the dispensing orifice;
- the application wall is more rigid than the bearing element, with each bearing element being locally deformable in the vicinity of the dispensing orifice on each side of the dispensing orifice;
- the application wall is formed by a thermoplastic elastomer, such as an ethylene and α-olefin copolymer;

it comprises a support holding or defining the application wall, in which the cap being capable of being screwed or snapped onto the support;

the application wall defines a plurality of separate dispensing orifices, in which each dispensing orifice is located between a first exterior contact region of a bearing element and a second interior contact region of a bearing element.

the intermediate region, the first exterior contact region and the second interior contact region mutually define a product confinement area into which the dispensing orifice opens.

the first contact region and the second contact region are formed by contact lines, with the radial span of each region being less than 5 times the radial span of the dispensing orifice, said transversal span being non zero.

the maximum radial distance radially separating the dispensing orifice from the first region and the second region is less than 5 times the maximum radial span of the dispensing orifice, the maximum radial distance separating the first region from the second region is greater than three times the maximum radial span of the dispensing orifice located between the first region and the second region, and is advantageously less than 10 times the maximum radial span of the dispensing orifice.

the application wall defines a contact protrusion around at least a dispensing orifice, the contact protrusion contacting the bearing element when the cap is in its closing position.

The invention also relates to a product dispensing head for a container including:

an application wall having a product-dispensing orifice, a removable cap comprising an bearing element on the application wall, which bearing element is suitable for exerting a pressure on the application wall at a distance from the dispensing orifice, characterized in that at least one element among the application wall and the bearing element is deformable, or has a hardness lower than the hardness of the other element, so as to close the dispensing orifice during contact of the bearing element on the application wall.

The dispensing head according to the invention may include one or more of the following features, considered alone or in any combination that is technically possible:

the dispensing orifice is formed by a slot passing through the application wall, the dispensing orifice has a curved shape, in particular in the form of an arc of circle, the dispensing orifice extends through the application wall according to a general axis inclined with respect to a normal to the application wall, considered at the level of the outlet of the dispensing orifice, it comprises a projection for activating the deformation, projecting with respect to either the application wall or the bearing wall so as to be inserted between the bearing element and the application wall at a distance from the dispensing orifice, the application wall is convex or concave, the application wall has a span greater than 1 $cm^2$, the application wall is smooth or textured, with the head advantageously comprising a plurality of elements for contact with the keratin surface projecting with respect to a downstream surface of the application wall, it comprises a perforated reinforcement, in particular resiliently deformable, applied under the application wall, it comprises a support holding or defining the application wall, with the cap being mobile with respect to the support between a closing position mounted on the support, in which the bearing element exerts a pressure on the application wall so as to close the dispensing orifice, and a product dispensing position, in which the cap is advantageously capable of being screwed or snapped onto the support, in the closing position, the bearing element exerts a pressure on the application wall at a distance from the dispensing orifice, in the closing position, the bearing surface exerts a pressure on each side of the dispensing orifice, the application wall defines a downstream surface, and an exterior peripheral surface, with the bearing element applying a pressure on the downstream surface and/or on the exterior peripheral surface.

The invention also relates to a product-dispensing device characterized in that it comprises:

a container, a dispensing head as described above, closing the container.

The device according to the invention can include one or more of the following features, considered alone or in any combination that is technically possible:

the container is formed by a flexible tube, the container contains a dispensing mechanism that advantageously includes a piston.

The invention will be easier to understand in view of the following description, provided solely as an example, and with reference to the appended drawings, in which.

Below, the terms "upstream" and "downstream" generally refer to the normal direction of circulation of a fluid, in particular a cosmetic product.

A first cosmetic product-dispensing device 10 according to the invention is shown in FIGS. 1 to 6.

The device 10 is intended to store, dispense and optionally apply a cosmetic product on a keratin surface of a user. The keratin surface is in particular the skin or keratin fibers of a user, such as the hair, advantageously grouped into locks.

The cosmetic product contained in the device 10 is, for example, a liquid, creamy, gel or pasty product. This cosmetic product is, for example, a cosmetic product for care, maintenance or coloring of the skin or hair, or a body hygiene product, such as in particular a deodorant.

The dispensing device 10 according to the invention comprises a container 12 defining an internal volume 14 for receiving the cosmetic product, and a cosmetic product dispensing head 16, closing the container 12.

Figure 1:
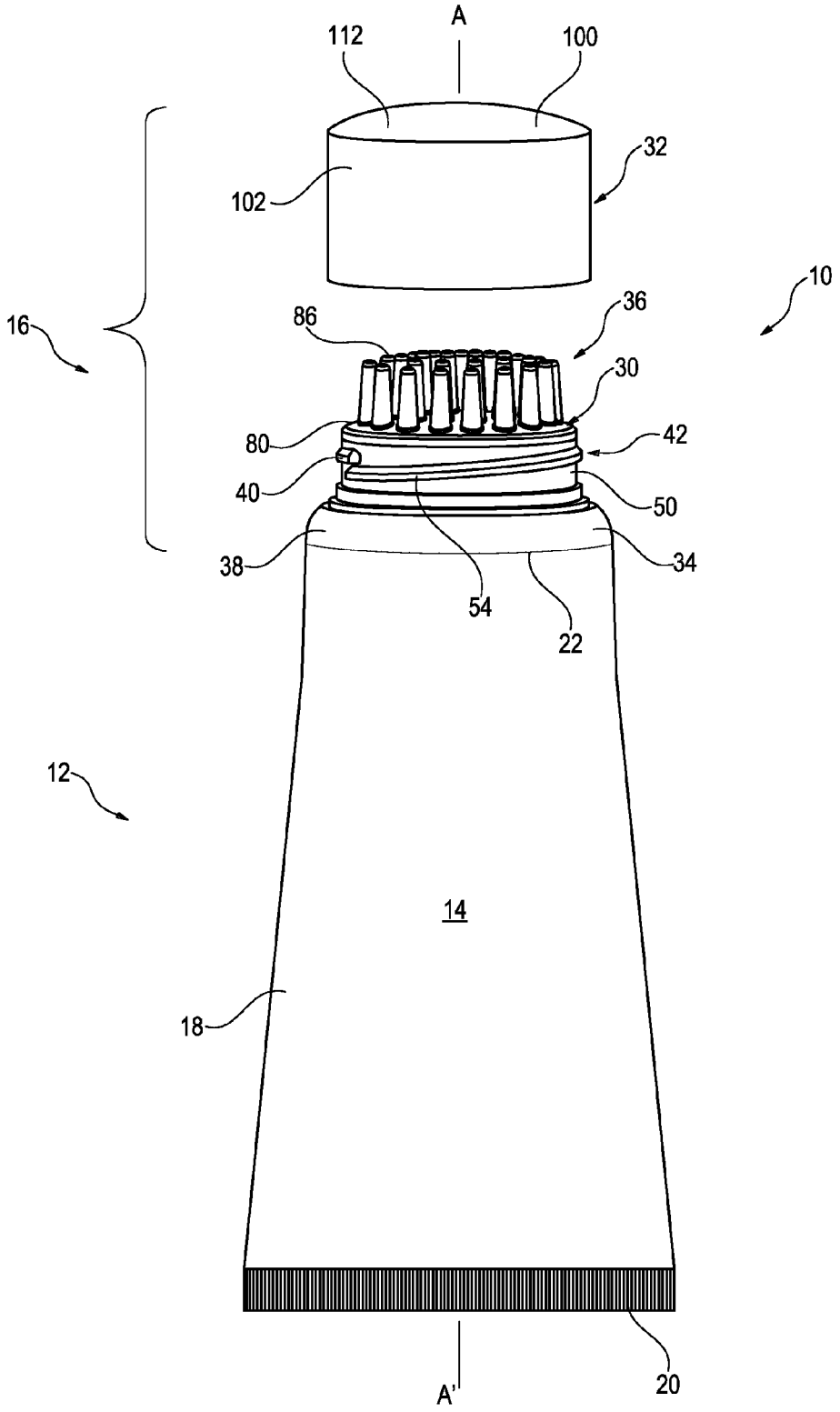
FIG. 1 is a side view of a first dispensing device equipped with a dispensing head according to the invention.

In the example shown in FIG. 1, the container 12 comprises a wall 18 that is deformable to the touch. This wall 18 is in particular deformable when it is pinched between a user's fingers.

Advantageously, the wall 18 of the container 12 forms a tube. The wall 18 is closed tightly at its upstream end 20 facing the head 16, for example by bonding or welding. At its downstream end 22, the wall 18 is closed selectively by the head 16.

The container 12 extends according to a general longitudinal axis A-A' between the ends 20, 22.

In this example, the head 16 is attached to the downstream end 22 of the container 12. It is, for example, attached by welding, or by insert molding of the wall 18 of the container 12 on the head 16. In an alternative, the head 16 and the container 12 are at least partially produced in a single piece.

The interior volume 14 is defined inside the container 12. It contains the cosmetic product.

As shown in FIG. 1, the head 16 comprises an application wall 30 and a cap 32 intended to cap the application wall 30. It advantageously comprises a support 34 holding the application wall 30 and, in the example shown in FIG. 1, a plurality of elements 36 for contact with the keratin surface, with the contact elements 36 projecting with respect to the application wall 30.

As shown in FIG. 1, the support 34 comprises an exterior skirt 38 secured to the wall 18 of the container 12, and a sleeve 40 for attachment of the cap 32 extending the exterior skirt 38 in the downstream direction. The support 34 also comprises at least one element 42 for holding the cap 32 on the support 34 and, in reference to FIG. 4, a perforated reinforcement 44 for supporting the application wall 30.

In this example, the support 34 is produced in a single piece from the same material. It is, for example, produced by injection molding from a thermoplastic material that is more rigid than that forming the application wall 30, such as polyethylene (PE), polypropylene (PP) or mixtures thereof.

The exterior skirt 38 and the sleeve 40 define a central passage 45 for circulation of product that leads through an upstream opening 46 defined by the exterior skirt 38 and through a downstream opening 48 defined by the sleeve 40. The circulation passage 45 extends the interior volume 14 in the downstream direction.

The sleeve 40 includes a peripheral tubular wall 50 and advantageously an annular edge 52 that projects partially toward the axis A-A' of the tubular wall 50 in the downstream opening 48. The edge 52 has, in this example, a shape curved in the downstream direction.

The support 34 has, in this example, a transverse exterior circular contour section. Alternatively, the exterior contour is elongated, and is, for example, oval or polygonal.

In the example shown in the figures, the cap 32 can be screwed onto the support 34. The holding element 42 is then formed by a thread 54 projecting radially outwardly with respect to the sleeve 40.

Alternatively, the cap 32 is snapped onto the support 34. The holding element 42, when it is present, is, for example, formed by means for snap-locking or holding the cap 32 clamping.

The reinforcement 44 projects transversally in the passage 45 at the level of the downstream opening 48. It is resiliently deformable with respect to the sleeve 40 along the axis A-A'.

The reinforcement 44 is perforated. Projected in a perpendicular section according to axis A-A', the span of the openings 68, 70 defined by the reinforcement 44 is greater than the span of the reinforcement 44.

In this example, the reinforcement 44 comprises an exterior ring 60, an interior disk 62, a plurality of exterior tabs 64 for connection between the sleeve 40 and the reinforcement 44 and a plurality of interior tabs for connection 66 between the exterior ring 60 and the interior disk 62.

The exterior ring 60 has an exterior contour contained in the interior contour defined by the sleeve 40 at the level of the edge 52.

The exterior tabs 64 connect the ring 60 to the edge 52. They define, between the ring 60 and the edge 52, a plurality of exterior openings 68 for passage of the product.

In this example, the exterior tabs 64 define two C-shaped openings 68 opening toward one another, on each side of a first transverse axis B-B'.

The interior disk 62 has an exterior contour contained in the interior contour of the exterior ring 60. It defines, with the exterior ring 60, at least one interior opening 70.

Figure 4:
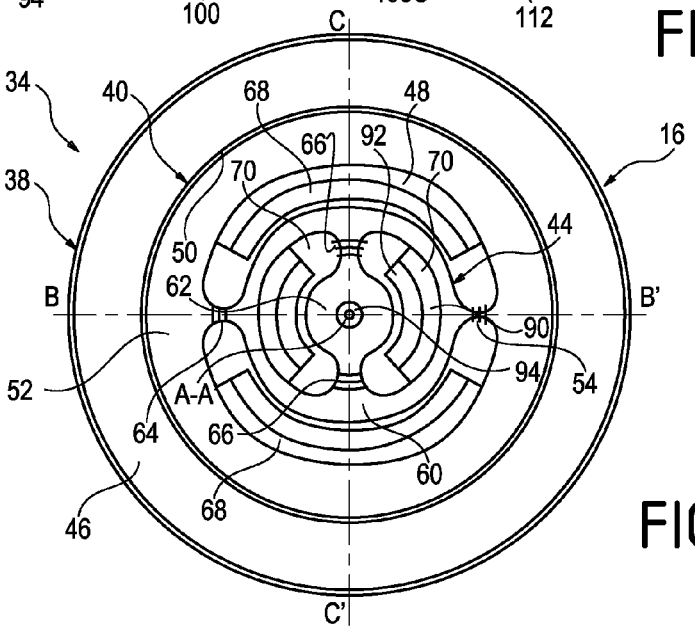
FIG. 4 is a bottom view of the head.

In the example shown in FIG. 4, the interior tabs 66 define two opposite C-shaped interior openings 70 opening toward one another, on each side of a second transverse axis C-C' angularly offset with respect to the axis B-B', and in particular perpendicular to the axis B-B'.

The application wall 30 is formed by a substantially flat body 80. By "substantially flat", we mean in particular that the thickness of the body 80 is less than 10 times its maximum dimension, in this case its diameter.

The thickness of the body 80 is, for example, less than 5 mm. The body 80 is advantageously produced with an elastomer base, such as elastomer, thermoplastic, thermoplastic elastomer, PEBD, PVC, PU, thermoplastic elastomer polyester materials, in particular butene terephthalate and esterified poly-tetramethylene oxide glycol copolymers, Hytrel®, EPDM, PDM, EVA, SIS, SEBS, SBS, latex, silicone, nitrile, butyl, polyurethane, polyether block amide, polyester, ethylene and α-olefin copolymers . . . . The material forming the wall 30 has a hardness lower than that of the material forming the support 34 and that of the material forming the cap 32.

In this example, the body 80 has an exterior contour with a shape substantially complementary to the exterior contour of the sleeve 40. It is thus capable of covering the sleeve 40 so as to close the downstream opening 48.

In this example, the body 80 has a convex dome shape, with the convexity in the downstream direction. It bears at its periphery on the sleeve 40 and is attached to it. To this end, it is applied on the annular edge 52.

In addition, the body 80 rests on the perforated reinforcement 44 by being attached to it.

As shown in FIGS. 2 to 5, the body 80 of the wall 30 defines at least one product dispensing orifice 82A, 82B, passing through the body 80 so as to open facing the downstream opening 48, advantageously facing the passage openings 68, 70 formed in the reinforcement 44.

In the example shown in the Figures, the body 80 of the application wall 30 defines a plurality of dispensing orifices 82A, 82B.

Figure 5:
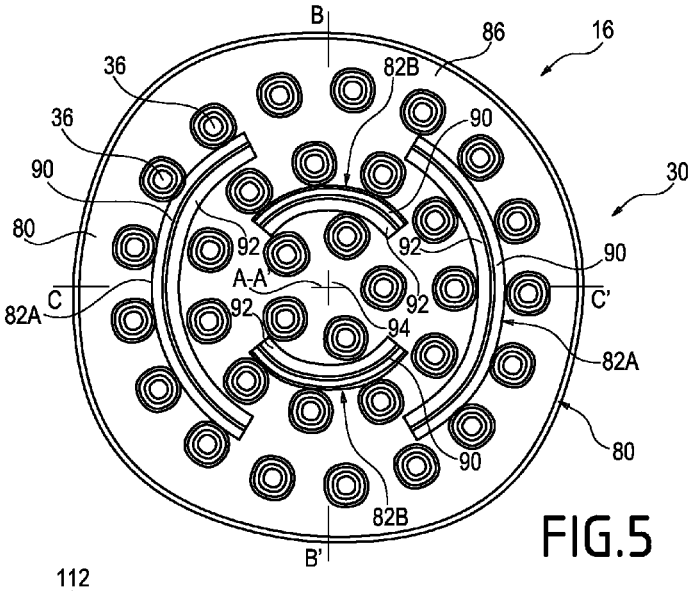
FIG. 5 is a top view of the head, with the cap having been removed.

In particular, in the example shown in FIG. 5, the body 80 defines two exterior dispensing orifices 82A, in particular C-shaped, and two interior dispensing orifices 82B, in particular C-shaped.

The interior orifices 82B are angularly offset with respect to the exterior orifices 82A and are located between the exterior orifices 82A.

The exterior orifices 82A advantageously extend facing the exterior openings 68, on each side of the axis B-B'. The interior orifices 82B advantageously extend facing the interior openings 70, on each side of the axis C-C' angularly offset with respect to the axis B-B'.

In this example, the dispensing orifices 82A, 82B are formed by curved slots 84 provided through the body 80 between a downstream surface 86 of the body 80 and an upstream surface 88 of the body 80.

In this example, the slots 84 extend, in a mid-plane section, according to a general axis D-D' inclined with respect to a normal N to the downstream surface 86, considered at the level of the outlet of the slot 84.

Each orifice 82A, 82B thus defines, in the body 80, a downstream lip 90 for closing the orifice 82A, 82B and a bearing edge 92 for the downstream lip 90.

According to the invention, and as will be seen below, the application wall 30 is deformable at the periphery of the orifice 82A, 82B so as to enable the selective closing of each dispensing orifice 82A, 82B.

Figure 2:
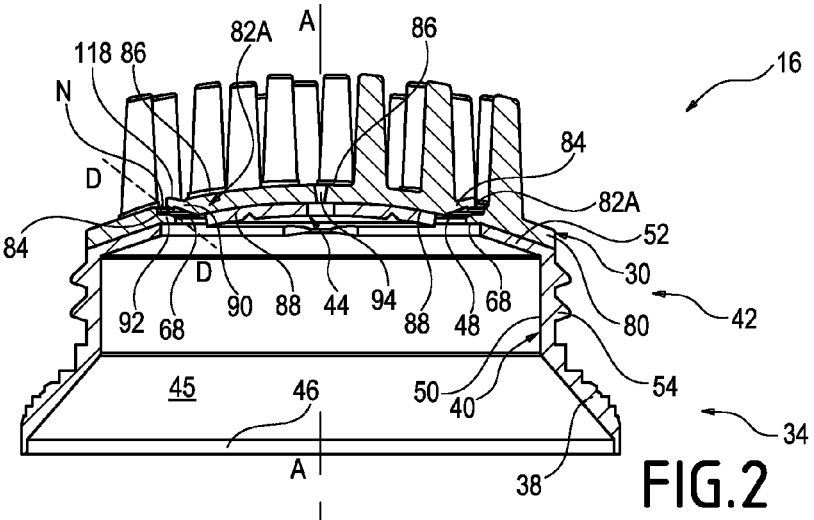
FIG. 2 is a cross-section view according to a vertical mid-plane, of the dispensing head of FIG. 1, with the cap having been removed.
Figure 3:
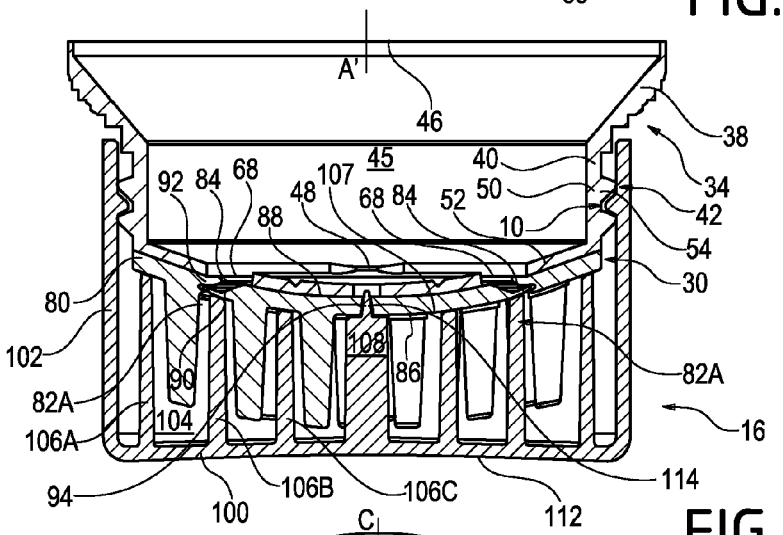
FIG. 3 is a view equivalent to that of FIG. 2, with the cap occupying a closing position.

In the example shown in FIG. 2, each downstream lip 90 is thus mobile by bending between a position of opening of the orifice 82A, 82B, shown in FIG. 2, in which the orifice 82A, 82B is cleared, and a position of closing of the orifice 82A, 82B, shown in FIG. 3.

In the closing position, the application wall 30 has been resiliently deformed so as to close each orifice 82A, 82B. In particular, in this example, the lip 90 has been applied against the edge 92 so as to close the slot 84.

In this example, the application wall 30 also comprises a pressure equalizing orifice 94 passing through the application wall 30. This orifice 94 is, for example, arranged at the center of the application wall 30.

In the example shown in the figures, the head 16 comprises a plurality of contact elements 36 distributed over the downstream surface 86.

Each contact element 36 thus projects downstream from the downstream surface 86. In this example, the contact elements 36 are in a single piece with the application wall 30. They extend in particular substantially parallel to one another according to the axis A-A'. Alternatively (not shown), they extend at an incline with respect to the axis A-A'.

The contact elements 36 thus form separation/combing members defining spaces for the passage of keratin fibers.

Figure 6:
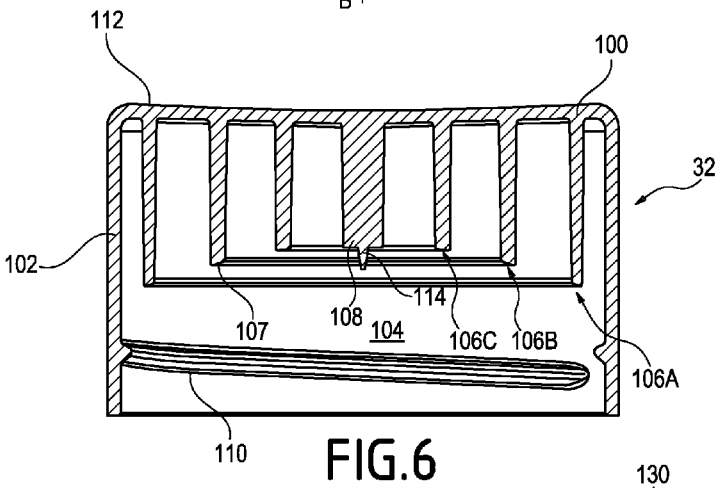
FIG. 6 is a cross-section view according to a mid-plane of the cap of the dispensing head.

As shown in FIGS. 1 and 6, the cap 32 comprises a downstream closing wall 100, and a side wall 102 projecting from the closing wall 100 so as to define an upstream volume 104 for receiving the wall 30.

The cap 32 also comprises at least one bearing element 106A, 106B, 106C on the application wall 30 and, advantageously, a projection 108 for closing the pressure equalizing orifice 94, when such an orifice is present.

The cap 32 also comprises a complementary holding element 110 intended to cooperate with the holding element 54.

The side wall 102 is tubular. It projects from the periphery of the downstream wall 100. The downstream wall 100 defines a downstream surface 112 suitable for being placed on a planar support so as to hold the device 10 upside down.

The downstream surface 112 is, for example, planar.

In an alternative (not shown), the cap 32 comprises a plurality of additional elements for contact with a keratin surface of a user. These elements project downstream from the downstream surface 112.

In this example, the cap 32 has a plurality of bearing elements 106A, 106B, 106C spaced apart from one another so as to bear on different regions of the application wall 30.

Thus, in reference to FIG. 6, the cap 32 comprises an exterior bearing element 106A, intended to be applied on a peripheral exterior region of the downstream surface 86, outside of the dispensing orifices 82A, 82B, an intermediate bearing element 106B, intended to be applied on the downstream surface 86, so as to cause the closing of the exterior orifices 82A and an interior bearing element 106C, intended to bear on the upper surface 86 so as to cause the closing of the interior orifices 82B.

In this example, the bearing elements 106A, 106B, 106C are all formed by concentric cylindrical skirts having axis A-A'.

When the application wall 30 has a curved shape, the exterior bearing element 106A has a height, parallel to the axis A-A', between the upper wall 100 and a free edge 107, greater than the height of the intermediate bearing element 106B, with this height being itself greater than that of the interior bearing element 106C.

The bearing elements 106A, 106B, 106C mutually define intermediate insertion spaces intended to receive contact elements 36.

The closing projection 108 projects into the volume 104 from the upper wall 100. It has an end pin 114 intended to be introduced into the pressure equalizing orifice 94 so as to close it.

In the example in which the cap 32 is intended to be screwed onto the support 34, the complementary holding element 110 is formed by a thread complementary to the thread present on the support 34.

In this example, the cap 32 is made in a single piece of a more rigid material, for example with a higher hardness, than the material forming the application wall 30.

In general, the bearing elements 106A, 106B, 106C have a rigidity greater than that of the application wall 30, in particular in the vicinity of the orifices 82A, 82B.

The cap 32 is mobile between a position for closing the head 16, shown in FIG. 3, and a product dispensing position, shown in FIG. 1.

In the dispensing position, the cap 32 is arranged at a distance from the support 34 and the application wall 30.

In this position, and as will be seen below, the dispensing orifices 82 are cleared or are capable of being cleared, so as to enable the cosmetic product to pass from the interior volume 14 through the passage 45 to the downstream surface 86 of the application wall 30.

In the closing position shown in FIG. 3, the cap 32 is engaged on the support 34 around it.

The holding elements 54 are engaged with the complementary holding elements 110.

In this position, the exterior bearing element 106A is applied on the upper surface 86 of the wall 30, in the vicinity of the periphery of this surface. It thus produces a peripheral seal.

The intermediate bearing element 106B is applied on a region of the downstream surface 86 located in the vicinity of each exterior orifice 82A so as to deform this region and close the exterior orifice 82A.

In particular, in the example shown in FIG. 3, the intermediate element 106B is applied on the downstream lip 90 defining the exterior orifice 82A and deforms this lip 90 so as to place it in contact with the upstream bearing edge 92. This deformation produces the substantially complete closing of each exterior orifice 82A.

Similarly, the bearing element 106C is applied on a region of the downstream surface 86 located in the vicinity of each interior orifice 82B so as to deform this region and close the interior orifice 82B.

In particular, in the example shown in FIG. 2, the interior element 106C is applied on the downstream lip 90 defining the interior orifice 82B and deforms this lip 90 so as to place it in contact with the upstream bearing edge 92. This deformation causes the substantially complete closing of each interior orifice 82B.

The closing of each dispensing orifice 82A, 82B is performed by a simple contact between the upper surface 86 and the free edge 107 of the bearing element 106B, 106C, without the bearing element 106B, 106C being inserted into the orifice 82A, 82B.

As shown in FIG. 3, the device 10 can then be stored upside down, with the cap 32 being located below the container 12. The orifices 82A, 82B are kept closed by the cooperation between each rigid bearing element 106B, 106C and the deformable region of the application wall 30 on which the bearing element 106B, 106C is applied.

In addition, when the air equalizing orifice is present, the closing projection 108 is applied around the orifice and the pin 114 tightly closes the orifice 94 by being inserted in it.

The application wall 30 and the contact elements 36 are advantageously made of a single piece by molding.

The orifices 82A, 82B are then produced, either during molding of the application wall 30 or after this molding, by providing openings by laser or mechanical cutting of the wall 30.

The use of a flexible material to produce the application wall 30 ensures that the molding of the orifices 82A, 82B can be performed simply, in particular at the level of the undercut parts located in the slots 84 between the lip 90 and the edge 92.

The device 10 according to the invention works as follows.

Initially, when the device 10 is stored, the cap 32 occupies its closing position engaged on the support 34, as shown in FIG. 3. The application wall 30 is received in the upstream volume 104. The holding elements 54, 110 cooperate with one another to hold the cap 32 in position with respect to the support 34 and with respect to the application wall 30.

In this position, and as seen above, the bearing elements 106B, 106C bear on the application wall 30 in the vicinity of the dispensing orifices 82A, 82B so as to close them.

When the user wishes to apply the cosmetic product, he or she releases the cap 32 so as to move it away from the head 16. The user then extracts the cosmetic product present in the interior volume 14 by pushing the product into the interior volume 14. This pushing can be produced by deformation of the wall 18 of the container 12 so as to place the contents of the container 12 under pressure.

The cosmetic product present in the container 12 then passes through the passage 45 and bears on the lips 90 so as to clear the dispensing orifices 82. The product then flows through the orifices 82A, 82B to the downstream surface 86 of the application wall 30.

The cosmetic product then impregnates the spaces between the contact elements 36, when they are present.

The user brings the downstream surface 86 of the application wall 30 into contact with a keratin surface, for example in contact with a lock of fibers. The cosmetic product is then applied on the keratin surface.

When the user has completed the product application, he or she replaces the cap 32 in its closing position, which closes the orifices 82A, 82B, as seen above.

The head 16 according to the invention is therefore particularly effective for dispensing the cosmetic product from the container 12, while maintaining a sealed confinement of the product in the container 12, when the device 10 is not used.

It is thus possible to mount and firmly hold the cap 32 on the support 34 of the wall 30 without the risk of leakage of the product, in particular when the device 10 is stored upside down. This holding can be ensured by screwing. The exterior bearing element 106A also ensures an adequate seal, by adding an external skirt.

In an alternative (not shown), the head 14 has an exterior transverse non-circular section, for example elliptical or polygonal. In this case, the cap 32 is snapped onto the support 34 by a simple translation movement along the axis A-A', without rotation around this axis A-A'.

In another alternative (not shown), the device 10 comprises a dispensing mechanism, such as a piston capable of being moved in the interior volume 14 so as to push the cosmetic product toward the head 16.

In an alternative, the dispensing orifices 82A, 82B are rectilinear, and not curved.

In an alternative, shown with dotted lines in FIG. 2, the head 16 comprises a projection 118 for activating the deformation of the wall 30, intended to be inserted between the wall 30 and a bearing element 106B, 106C when the cap 32 occupies its closing position.

The activation projection 118 projects, for example, toward the cap 32 from the application wall 30. Advantageously, the activation projection 118 extends from a lip 70. It is formed in particular by a protuberance.

Alternatively, the projection 118 projects toward the application wall 30 from a bearing element 106B, 106C.

In another alternative, the downstream surface 86 of the application wall is textured. It has, for example, a plurality of recesses and protuberances, as seen on a golf ball.

FIGS. 7 to 10 show alternatives of the dispensing head 16 for dispensing devices according to the invention.

Figure 7:
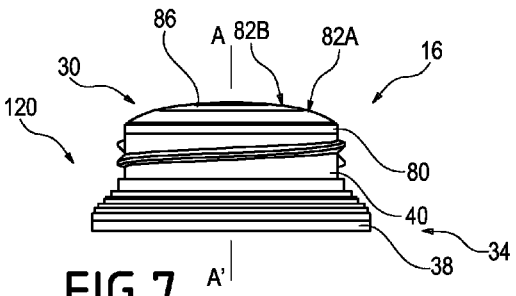
FIG. 7 is a side view of the dispensing head of a second device according to the invention.

A second device 120 according to the invention is shown in FIG. 7.

The head 16 of the device 120 is free of contact elements 36. The downstream surface 86 is then smooth.

In this device 120, the orifices 82A, 82B are advantageously produced by laser cutting.

Figure 8:
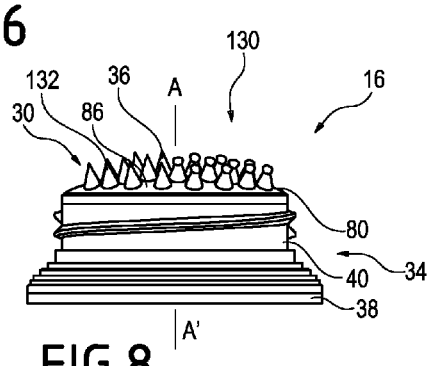
FIG. 8 is a view equivalent to that of FIG. 7, for a third device according to the invention.

A third device 130 according to the invention is shown in FIG. 8.

In this device, the contact elements 36 are massage elements. They have a short length, in particular a length less than the height of the support 34, along the axis A-A'. The massage elements comprise a flat area 132 at their free ends.

In an alternative (shown with dotted lines) of the device of FIG. 8, the massage elements comprise, at their free ends, a substantially spherical ball. Each contact element 36 has substantially a mushroom shape.

Figure 9:
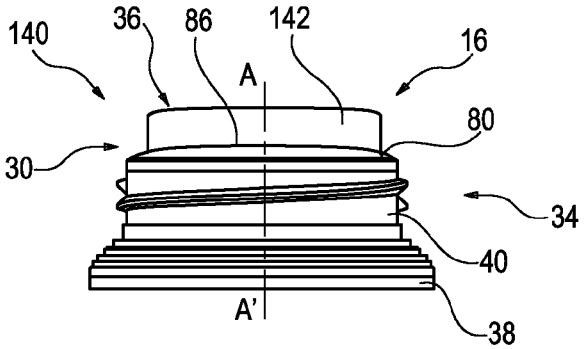
FIG. 9 is a view equivalent to that of FIG. 7, for a third device according to the invention.

A fourth device 140 according to the invention is shown in FIG. 9.

Unlike the first device 10, the head 16 comprises contact elements 36 formed by scraping blades 142. The blades 142 are arranged externally with respect to the orifices 82A, 82B, on each side of the axis B-B', in the vicinity of the periphery of the application wall 30.

The blades 142 have, in a section along a plane perpendicular to the axis A-A', a C-shaped contour. They are advantageously made in one piece with the application wall 30.

Figure 10:
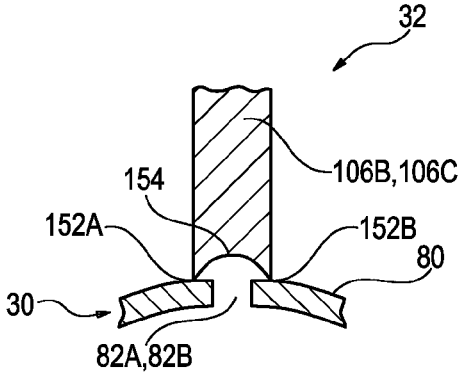
FIG. 10 is a view of a detail of an alternative of the dispensing head according to the invention.

FIG. 10 shows the head 14 of a fifth device 150 according to the invention. Unlike the devices shown above, the application wall 30 is more rigid than each bearing element 106B, 106C. Each bearing element 106B, 106C is locally deformable in the vicinity of the orifice 82A, 82B on each side of it.

The bearing element 106B, 106C thus has two deformable and separate contact regions 152A, 152B. The regions 152A, 152B are intended to be applied on the downstream surface 86, on each side of the orifice 82A, 82B.

The bearing element 106B, 106C advantageously has, between the regions 152A, 152B, a hollow intermediate region 154 intended to be placed facing and outside the orifice 82A, 82B when the cap 32 occupies its closing position.

In the first device 10 according to the invention, the bearing elements 106B, 106A are applied directly on the downstream surface 86 at a distance from the dispensing orifice 82A, 82B.

Figure 11:
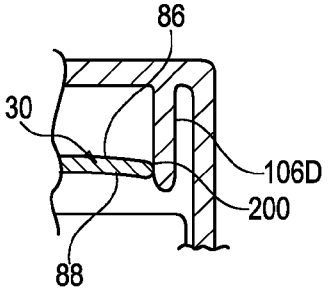
FIG. 11 is a partial cross-section view of an alternative of the dispensing head according to the invention.

In the alternative shown in FIG. 11, the application wall 30 defines a peripheral surface 200 located on its edge, in its thickness, between the downstream surface 86 and the upstream surface 88. At least one bearing element 106D laterally bears on the peripheral surface 200 of the wall 30 so as to close each orifice 82A, 82B.

Figure 12:
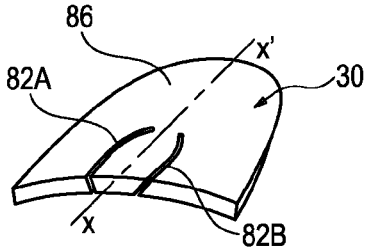
FIG. 12 is a perspective view, according to a partial cross-section, of the application wall of an alternative of the head according to the invention.

In the alternative shown in FIG. 12, the wall 30 has an elongated shape according to a middle axis X-X'. In this case, the cap is snapped onto the support 34, as described above. The slots defining the dispensing orifices 82A, 82B are, for example, present on the wall 30 on each side of the longitudinal axis X-X'.

Advantageously, the wall 30 has a curved shape so that the downstream surface 86 is convex and the upstream surface 88 is concave.

In this case, a bearing element (not shown) formed by an elongated skirt according to the axis X-X' or by a straight rib extending substantially along the axis X-X' is used to close each dispensing orifice 82A, 82B during contact of the bearing element on the application wall.

In an alternative (not shown), the upper wall 100 of the cap 32 directly forms the application element applied on the wall 30.

Figure 13:
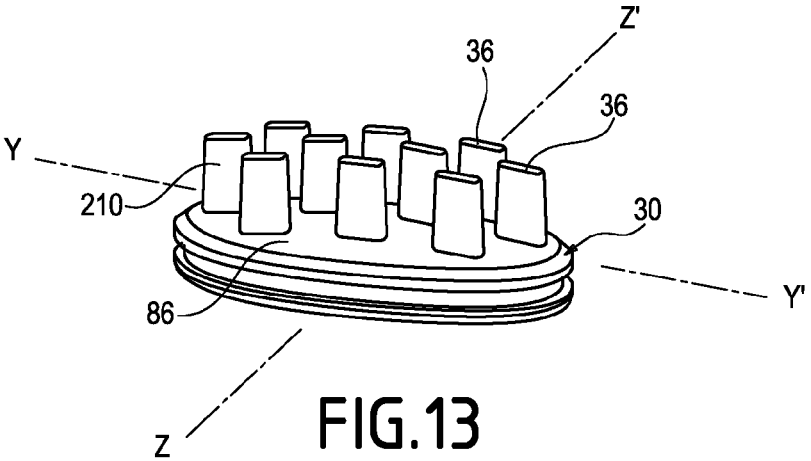
FIG. 13 is a view equivalent to that of FIG. 7 of an alternative of a head according to the invention.

In the alternative shown in FIG. 13, the contact elements 36 are formed by elongate blade-type pins 210. The elongate pins have axes of extension substantially parallel to a common Y-Y' axis. Thus, the head 14 shown in FIG. 13 can be used in a first direction, parallel to the axis Y-Y' of extension of the pins 210 for the formation and may be used according to an axis Z-Z' perpendicular to the axis of extension of the pins 210, for plaiting hair.

The terms "one", "two", and so on should be understood as meaning "at least one", "at least two", unless otherwise indicated.

A sixth cosmetic product dispensing device 310 according to the invention is shown in FIGS. 14 to 19 and 24.

A device 310 is intended to store, dispense and optionally apply a cosmetic product on a keratin surface of a user. The keratin surface is in particular the skin or the keratin fibers of a user, such as the hair, advantageously grouped into locks.

The cosmetic product contained in the device 310 is, for example, a liquid, creamy, gel, or pasty cosmetic product. This cosmetic product is advantageously a body hygiene product, such as, in particular, a deodorant. Alternatively, the product is a cosmetic product for care, maintenance or coloring of the skin or the hair. Alternatively, the cosmetic product contained in the device 310 is a sun protection product, or a makeup product.

Figure 15:
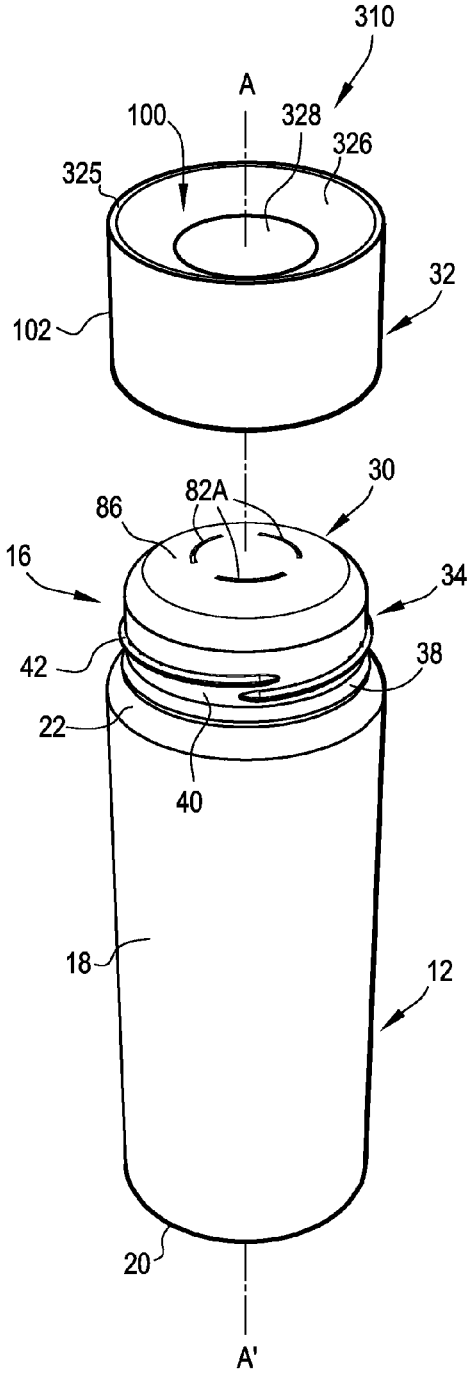
FIG. 15 is a three-quarter frontal perspective view of the device of FIG. 14, with the cap having been removed from the dispensing head.

The dispensing device 310 according to the invention comprises a container 12 defining an interior volume 14 for receiving the cosmetic product, and a cosmetic product dispensing head 16, closing the container 12 (seen in FIG. 15).

Figure 14:
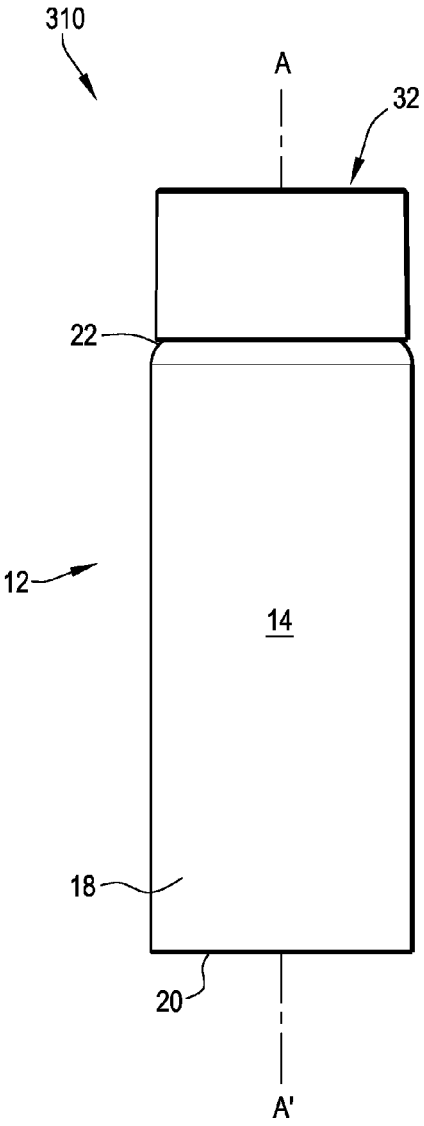
FIG. 14 is a side view of a sixth dispensing device, in which the cap occupies its closing position.

In the example shown in FIGS. 14 and 15, the container 12 comprises a wall 18 that advantageously forms a tube. The wall 18 is closed tightly at its upstream end 20 facing the head 16. At its downstream end 22, the wall 18 is closed by the head 16.

The base of the wall 18 is advantageously closed by pinching and by welding of the wall 18.

In an alternative, the container 12 comprises a wall 18 deformable to the touch. This wall 18 is in particular deformable when it is pinched between the fingers of a user.

The container 12 extends according to a general longitudinal axis A-A' between the ends 20, 22.

Alternatively, the head 16 is attached to the downstream end 22 of the container 12.

Advantageously, the head 14 is attached to the neck of the container 12 and is attached to the neck by snap-locking. To this end, the head 14 is snapped on the neck of the container 12 and is held on the neck with stops.

Alternatively, the head 16 is attached by welding, or by insert molding of the wall 18 of the container 12 on the head 14. In another alternative, the head 14 and the container 12 are at least partially made in a single piece.

In this example, the container 12 contains a dispensing mechanism (not shown) suitable for pushing the cosmetic product contained in the interior volume 14 toward the head 16 out of the container. This dispensing mechanism advantageously comprises a piston (not shown), and a piston maneuvering mechanism (not shown) accessible from outside.

The interior volume 14 is defined inside the container 12. It contains the cosmetic product.

Figure 16:
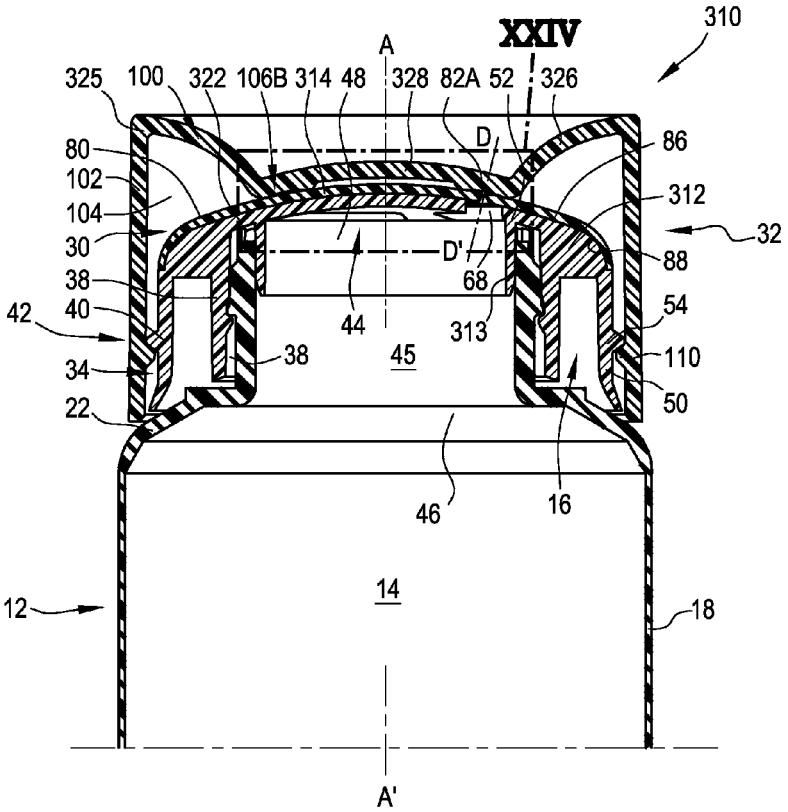
FIG. 16 is a cross-section view according to a vertical mid-plane of the device of FIG. 14.
Figure 24:
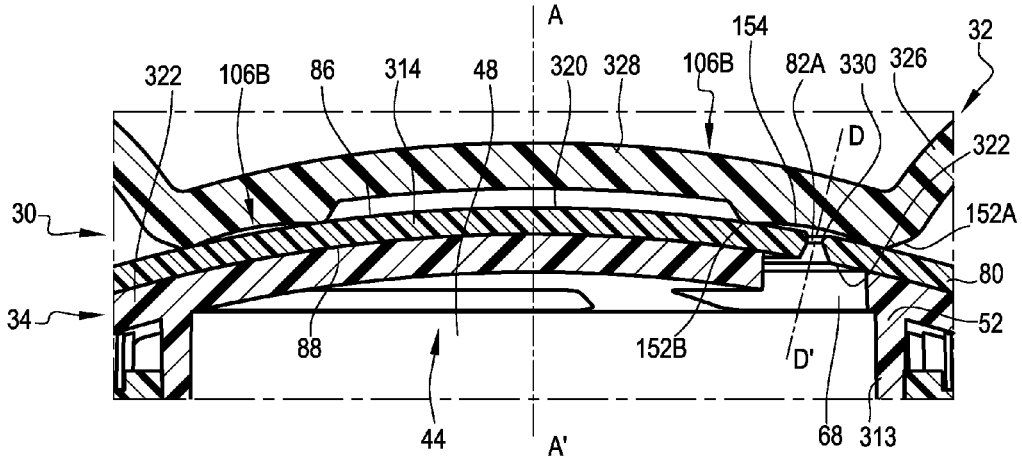
FIG. 24 is a view of a detail marked XXIV in FIG. 16.

As shown in FIGS. 15, 16 and 24, the head 14 comprises an application wall 30 and a cap 32 intended to cap the application wall 30. It advantageously comprises a support 34 holding the application wall 30.

As shown in FIG. 16, the support 34 comprises an interior skirt 38, attached on the wall 18 of the container 12, and an exterior sleeve 40 for attachment of the cap 32 arranged around the skirt 38. The support 34 also comprises at least one element 42 for holding the cap 32 on the support 34 and, in reference to FIG. 19, a perforated reinforcement 44 for holding the application wall 30.

In this example, the support 34 is made in a single piece of the same material. It is, for example, produced by insert molding using a thermoplastic material that is more rigid than that forming the application wall 30, such as polyethylene (PE), polypropylene (PP) or mixtures thereof.

Alternatively, the support 34 directly forms the application wall 30.

The skirt 38 defines a central passage 45 for circulation of the product that leads through an upstream opening 46 through a downstream opening 48. The circulation passage 45 extends the interior volume 14 downstream.

The sleeve 40 includes a peripheral tubular wall 50 and a downstream bridge 312 connecting it to the skirt 38. The skirt 38 advantageously defines an annular edge 52 that projects partially toward the axis A-A', with the edge 52 being extended upstream by a sealing skirt 313 inserted into the neck of the container 12 so as to hold the product.

The support 34 has, in this example, a cross-section with a circular exterior contour. Alternatively, the exterior contour is elongated, for example oval or polygonal.

In the example shown in the figures, the cap 32 can be screwed onto the support 34. The holding element 42 is then formed by a thread 54 projecting radially outwardly with respect to the sleeve 40.

Alternatively, the cap 32 is snapped onto the support 34. The holding element 42, when it is present, is, for example, formed by means for snap-locking or holding the cap 32 by clamping.

The reinforcement 44 projects transversally in the passage 45 at the level of the downstream opening 48. It is rigid or semi-rigid.

The reinforcement 44 is perforated. In the example shown in FIG. 19, the reinforcement 44 comprises an interior disk 62 and a plurality of exterior tabs 64 for connection between the edge 52 of the skirt 38 and the reinforcement 44.

The exterior tabs 64 connect the edge 52 of the skirt 38 to the disk 62. They define, between the skirt 38 and the disk 62, a plurality of exterior product passage openings 68.

In this example, the exterior tabs 64 define a plurality of C-shaped openings 68 opening toward one another facing the axis A-A'.

In this example, the number of openings 68 is equal to 3. More generally, this number is between 1 and 10.

The interior disk 62 has an exterior contour contained in the interior contour of the skirt 38.

The application wall 30 is formed by a polymer material body 80. The thickness of the body 80 is, for example, less than 5 mm. The body 80 is advantageously based on an elastomer, such as elastomer, thermoplastic, thermoplastic elastomer, PEBD, PVC, PU, thermoplastic elastomer polyester materials, in particular butene terephthalate and esterified poly-tetramethylene oxide glycol copolymers, Hytrel®, EPDM, PDM, EVA, SIS, SEBS, SBS, latex, silicone, nitrile, butyl, polyurethane, polyether block amide, polyester, ethylene and α-olefin copolymers. In this embodiment, the material forming the wall 30 has a hardness lower than that of the material forming the support 34 and that of the material forming the cap 32.

The support 34 and the wall 30 are advantageously formed by bi-injection of material. In an alternative, the support 34 and the wall 30 are formed by injection of the same material.

In this example, the body 80 has an exterior contour with a shape substantially complementary to the exterior contour of the support 34. It is thus capable of covering the support 34 in order to close the downstream opening 48.

In this example, the body 80 has a convex dome shape, with a convexity directed downward. It bears at its periphery on the support and is attached on it. To this end, it is applied on the annular edge 52, and on the bridge 312.

In addition, the body 80 rests on the perforated reinforcement 44 by being attached to it.

Figure 17:
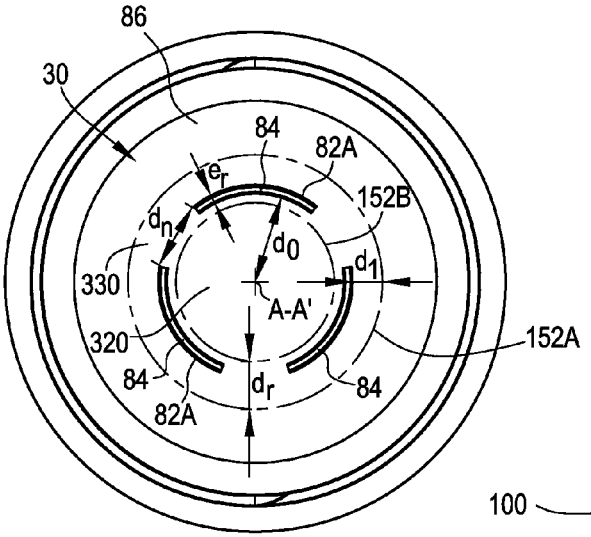
FIG. 17 is a top view of the dispensing head of the device of FIG. 14.
Figure 19:
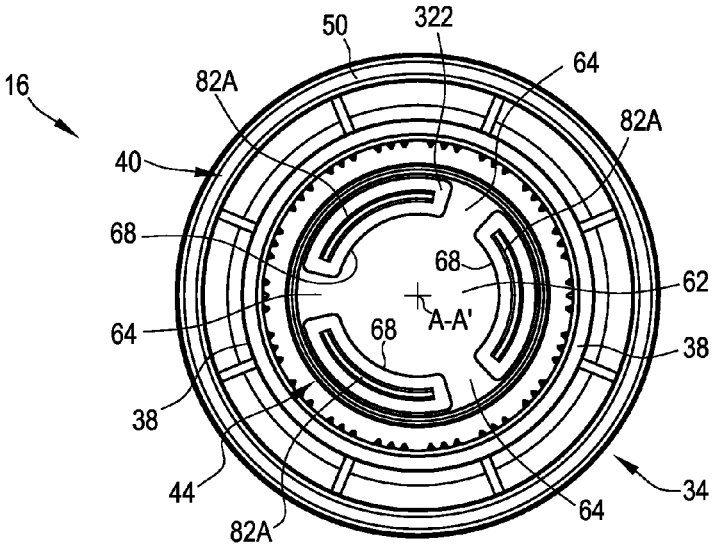
FIG. 19 is a bottom view of the head of the device of FIG. 14.

As shown in FIGS. 17 and 19, the body 80 of the wall 30 defines at least one product dispensing orifice 82A, passing through the body 80 so as to open facing the downstream opening 48, advantageously facing the through-openings 68 provided in the reinforcement 44.

In the example shown in the figures, the body 80 of the application wall 30 defines a plurality of dispensing orifices 82A, in particular C-shaped.

The orifices 82A advantageously extend facing the openings 68.

In this example, the dispensing orifices 82A are formed by curved slots 84 provided through the body 80 between a downstream surface 86 of the body 80 and an upstream surface 88 of the body 80.

In this example, the slots 84 extend, in a mid-plane section, according to a general axis D-D' corresponding to a normal N to the downstream surface 86, considered at the level of the outlet of the slot 84. Alternatively, the slots extend according to an axis D-D' inclined with respect to a normal N to the downstream surface 86.

As shown in FIG. 17, the dispensing orifices 82A are off-centered with respect to the central axis A-A' of the wall 30. The central axis A-A' is defined as the axis passing through the center of the downstream surface 86 of the wall 30, normal to this surface. In this example, the central axis A-A' coincides with the general axis A-A' of the container 12.

The distance d0 radially separating the axis A-A' of each orifice 82A is greater than the radial er maximum span of each orifice 82A. Thus, as shown in FIG. 17, the wall 30 has a solid central area 320, free of an orifice 82A, in particular at the level of the axis A-A'.

In an alternative, the application wall 30 also defines a pressure equalizing orifice (not shown) passing through the application wall 30. This orifice is, for example, arranged at the center of the application wall 30 in the central area 320.

The slots 84 have a length much greater at their radial span er. Thus, the length of each slot 84 is at least greater than twice the maximum radial span er of the slot 84. Advantageously, the radial span of each slot 84 is non zero, and the slots 84 are opened.

The orifices 82A are separate, i.e. they are separated from one another by solid regions of the application wall 30. In this example, the minimum distance do separating two adjacent orifices 82A is greater than the maximum radial span er of each orifice 82A.

In the example of FIG. 17, the orifices 82A are distributed angularly around the axis A-A', according to a circumference around this axis.

The angular span of each orifice 82A around the axis A-A' is less than 360°/N in which N is the number of orifices 82A over a circumference. The angular span of each orifice 82A is in particular less than (360°-10N)/N.

More generally, the maximum radial span er of each orifice 82A, with respect to the axis A-A', is less than 5 mm, and in particular less than 1 mm. This radial span is advantageously greater than 0.4 mm. Thus, the edges of each orifice 82A are constantly located at a distance from one another.

Each dispensing orifice 82A is placed facing an opening 68.

Each orifice 82A, however, has an area below the area of the opening 68 facing which it is placed. Thus, as shown in FIG. 19, the wall 30 defines, around each orifice 82A, and facing the opening 68, a peripheral edge 322.

Alternatively, each orifice 82A has a span substantially equal to the opening 68 facing which it is located. In yet another alternative (see e.g. FIG. 27), the orifice 82A is off-centered with respect to the opening 68. It is for example located along an edge of the opening 68. In this case, the peripheral edge 322 has a substantial width and is capable of directing the product dispensing through the orifice 82A so as to improve its distribution over the downstream surface 86.

In the example shown in FIGS. 14 to 19, each dispensing orifice 82A is constantly clear, even when the cap 32 occupies a closing position mounted on the support 34. Thus, at any time, the dispensing orifice 82A is clear over the entire width of the body 80, and no element is attached in the thickness of the dispensing orifice 82A or penetrates the thickness of the dispensing orifice 82A.

As will be seen below, each dispensing orifice 82A can be closed in the downstream direction by the cap 32 when the cap 32 occupies its closing position.

In the example shown in FIGS. 14 to 19, the downstream surface 86 of the wall is smooth. To this end, it lacks roughnesses or macroscopic projections.

By "roughness or macroscopic projection", we mean a roughness or a projection with a thickness, measured perpendicularly to a normal to the wall 30, that is greater than the thickness of the wall 30.

Thus, the wall 30 is capable of sliding over the skin of a user. It is in particular free of roughnesses or macroscopic projections at the periphery of the openings 82A, allowing for a pleasant application of the product over a body surface of the user.

As shown in FIG. 16, the cap 32 comprises a downstream closing wall 100, and a side wall 102 projecting from the closing wall 100 so as to define an upstream volume 104 for receiving the wall 30.

The cap 32 also comprises at least one bearing element 106B on the application wall 30.

The cap 32 also includes a complementary holding element 110, intended to cooperate with the holding element 54 on the support 34.

The side wall 102 is tubular. It projects from the periphery of the downstream wall 100. The downstream wall 100 defines a downstream edge 325 suitable for being placed on a planar support so as to hold the device 10 upside down. The downstream edge 325 is, for example, planar.

The downstream wall 100 in this case has a dish shape projecting inwardly. It comprises, in this example, a peripheral skirt 326 and a central dome 328.

Figure 18:
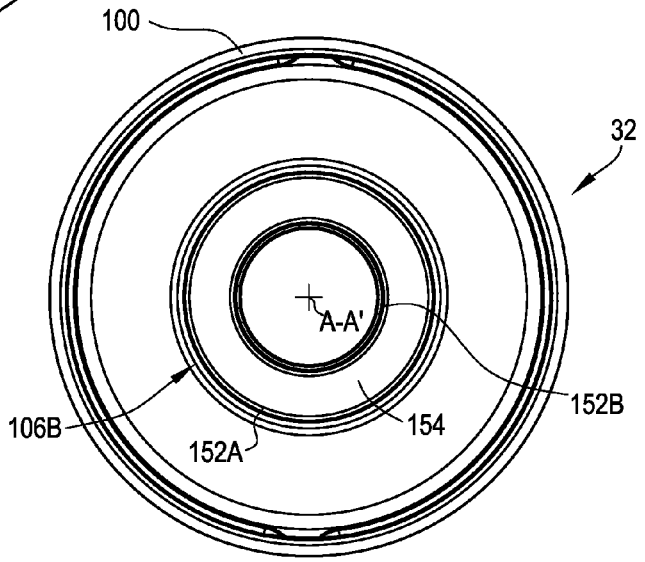
FIG. 18 is a bottom view of the closing cap of the device of FIG. 14.

In this example, and as shown in FIGS. 18 and 24, the cap 32 has a bearing element 106B which revolves about the axis A-A' of the cap 32. This bearing element 106B is, for example, annular. It projects inwardly from the downstream wall 100. According to the invention, the bearing element 106B has a first exterior region of contact 152A with the application wall 30 and a second interior region 152B of contact with the application wall 30.

In this example, each contact region 152A, 152B has a closed contour so as to ensure a peripheral seal.

The regions 152A, 152B are separate. The interior region 152B is contained inside the surface defined by the exterior region 152A. The regions 152A, 152B are advantageously concentric, having axis A-A'.

The regions of contact 152A, 152B mutually define an annular intermediate hollow region 154 intended to be placed facing the orifices 82A.

Each contact region 152A, 152B hence protrudes from the hollow region 154.

In reference to FIG. 17, the minimum radial distance dr separating the first region 152A from the second region 152B is greater than the maximum radial span er of the orifices 82A and in particular greater than 3 times the radial span er.

However, the maximum radial distance dr separating the first region 152A from the second region 152B is less than 10 times, advantageously 5 times the maximum radial span er of the orifices 82A.

The maximum radial distance dr is for example greater than 0.5 mm and in particular comprised between 0.5 mm and 10 mm, advantageously between 2 mm and 5 mm.

In this example, the cap 32 is made in a single piece of a more rigid material, for example with a higher hardness, than the material forming the application wall 30.

In general, in this embodiment, the bearing element 106B has a rigidity greater than or equal to that of the application wall 30, in particular in the vicinity of the orifices 82A.

Alternatively, the application wall 30 has a rigidity greater than or equal to that of the bearing element 106B, in particular in the vicinity of the orifices 82A.

The cap 32 is mobile with respect to the support 34 and to the wall 30 between a head closing position and a dispensing position.

In the closing position, the cap 32 is engaged on the support 34 around it. The holding elements 54 are engaged with the complementary holding elements 110.

In this position, the contact regions 152A, 152B are applied on the application wall 30 and advantageously deform it so as to provide a seal over the entire periphery around the axis A-A', radially inside and outside the orifices 82A.

An effective closing of the orifices 82A in the downstream direction is therefore performed in a simple and inexpensive manner. No bearing element 106B is inserted in the orifices 82A, thereby limiting the risk of pollution and ensuring an ease of use, and a more effective seal.

The device 310 can then be stored upside down, with the cap 32 being located below the container 12. The orifices 82A are kept closed by the cooperation between each bearing element 106B and the deformable application wall 30 on which the bearing element 106B is applied.

As shown in FIG. 24, when the cap 32 occupies its position for closing the head 16, the regions 152A, 152B are in contact with the downstream surface 86 and define, facing the downstream surface 86, a closed cosmetic product confinement volume 330.

The closed volume 330 is tightly circumferentially closed by the contact regions 152A, 152B and in the downstream direction by the hollow region 154.

In this position, and in reference to FIG. 17, the minimum radial distance d1 separating each orifice 82A of the first region 152A or of the second region 152B is preferably greater than the maximum radial span er of the orifice 82A. In addition, this maximum radial distance is advantageously less than 5 times the maximum radial span er of the dispensing orifice 82A.

Distance d1 is usually less than or equal to 5 mm and is advantageously comprised between 0.25 mm and 5 mm.

Similarly, the maximum distance separating the downstream surface 86 from the bearing element 106B along an axis D-D' normal to the surface 86, measured at the level of the orifice 82A, which corresponds to the depth of the hollow region 154, is less than 5 mm.

Thus, the free volume defined facing the closed area 330 is minimal. This volume is, for example, less than 1 ml, and is advantageously less than 0.2 ml.

In the dispensing position, the cap 32 is arranged at a distance from the support 34 and the application wall 30.

In this position, and as will be seen below, the dispensing orifices 82A are cleared so as to enable the cosmetic product to pass from the interior volume 14 through the passage 45 to the downstream surface 86 of the application wall.

In the example in which the cap 32 is intended to be screwed onto the support 34, the complementary holding element 110 is formed by a thread complementary to the thread present on the support 34.

The application wall 30 is advantageously made in a single piece by molding.

The orifices 82A, 82B are then produced, either during molding of the application wall 30, or after this molding, by providing openings by laser or mechanical cutting of the wall 30.

The use of a flexible material to produce the application wall 30 ensures that the molding of the orifices 82A, 82B can be produced simply.

The device 310 according to the invention works as follows.

Initially, when the device 310 is stored, the cap 32 occupies its closing position engaged on the support 34, as shown in FIG. 14. The application wall 30 is received in the upstream volume 104. The holding elements 54, 110 cooperate with one another to hold the cap 32 in position with respect to the support 34 and with respect to the application wall 30.

In this position, and as seen above, the bearing element 106B bears on the application wall 30 in the vicinity of the dispensing orifice 82A so as to close them.

To this end, each region 152A, 152B forms a contact line that produces a sealed contact on the wall 30. The width of each contact region 152A, 152B is then less than 5 times the maximum radial span er of each opening 82A.

The width of each contact region 152A, 152B is, for example, between 0.25 mm and 4 mm.

Each contact region 152A, 152B is also arranged at a distance from the openings 68 provided through the support 34, facing a solid region of the support 34.

The cosmetic product present in the interior volume 14 is then incapable of flowing out of the device 310, since it is confined in the closed area 330 defined between the contact regions 152A, 152B and by the hollow region 154.

When the user wishes to apply the cosmetic product, he or she releases the cap 32 so as to move it away from the head 16. The user then extracts the cosmetic product present in the interior volume 14 by pushing the product into the interior volume 14.

The cosmetic product present in the container 12 then passes into the passage 45. It then flows through the orifices 82A to the downstream surface 86 of the application wall 30. Advantageously, the cosmetic product raises the edge 322 around the orifice 82A.

The cosmetic product then impregnates the downstream surface 86.

The user brings the downstream surface 86 of the application wall 30 in contact with a body surface, for example in contact with the skin. The cosmetic product is then applied on the body surface.

When the user has completed the product application, he or she returns the cap 32 to its closing position, closing the orifices 82A, as seen above.

The head 16 according to the invention is therefore particularly effective for dispensing the cosmetic product from the container 12, while keeping a sealed confinement of the product in the container 12, when the device 10 is not used.

It is thus possible to mount and firmly hold the cap 32 on the support 34 of the wall 30 without any risk of leakage of the product, in particular when the device 10 is stored upside down. This holding can be ensured by screwing.

In an alternative (not shown), the head 14 has an exterior transverse non-circular section, for example elliptical or polygonal. In this case, the cap 32 is snapped onto the support 34 by a simple translation movement along the axis A-A', without rotation around this axis A-A'.

In another alternative, the downstream surface 86 of the application wall is textured. It has, for example, a plurality of recesses and protuberances, as seen on a golf ball.

Figure 20:
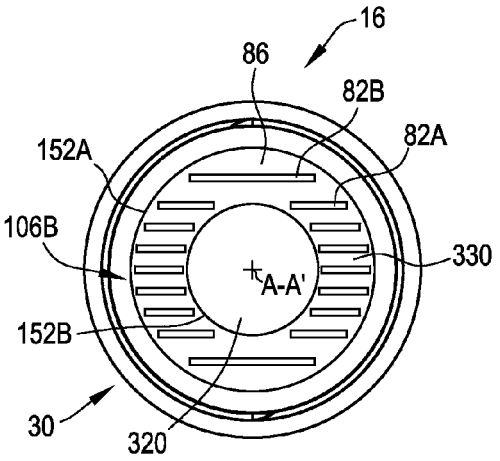
FIGS. 20 to 23 are views equivalent to that of FIG. 17 of alternatives of dispensing heads according to the invention.

In one alternative, shown for example in FIG. 20, the dispensing orifices 82A, 82B are rectilinear and not curved.

The orifices 82A, 82B have lengths that can be different from one another. For example, a first group of orifices 82A has a length lower than that of a second group of orifices 82B.

Figure 21:
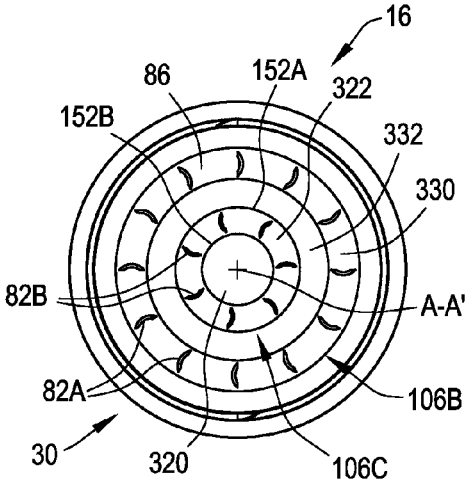

In another alternative shown in FIG. 21, the application wall 30 defines a first group of orifices 82A located radially outside a second group of orifices 82B.

The orifices 82A are, for example, distributed over an exterior circumference of the application wall 30, while the orifices 82B of the second group are distributed over an interior circumference of the application wall 30.

In this example, the cap 32 comprises at least one first exterior bearing element 106B and at least one second interior bearing element 106C. The exterior bearing element 106B is intended to tightly close the orifices 82A of the first group and the interior bearing element 106C is intended to tightly close the orifices 82B of the second group. Each bearing element 106B, 106C thus defines a first exterior contact region 152A and a second interior contact region 152B mutually defining a closed confinement area 330. Thus, the confinement area 330 defined by the interior bearing element 106B is placed facing each orifice 82A of the first group. The confinement area 330 defined by the interior bearing element 106C is placed facing each orifice 82B of the second group.

The bearing elements 106B, 106C mutually define, on the downstream surface 86, a solid intermediate region 332 without orifices 82A, 82B.

Figure 22:
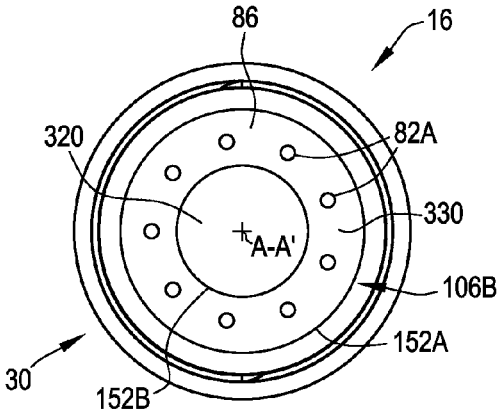

Another alternative of the application head 16 is shown in FIG. 22. In this alternative, the dispensing orifices 82A are formed by holes with a circular or oblong section, and not by slots.

The maximum transversal dimension of each orifice 82A is less than twice the minimum transversal dimension of the orifice 82A.

Figure 23:
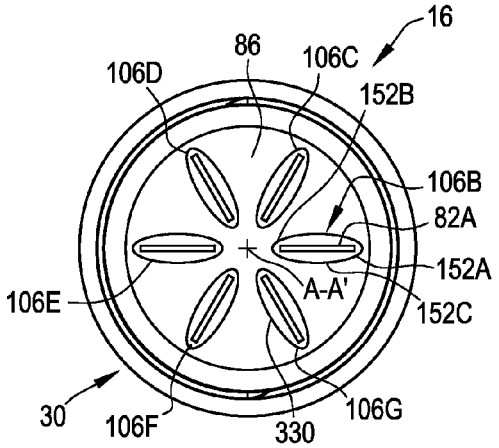

Yet another alternative of the head 16 according to the invention is shown in FIG. 23. In this alternative, each closed confinement area 330 contains a single orifice 82A. To this end, the cap 32 comprises a bearing element 106B to 106G associated with each orifice 82A. Each bearing element 106B to 106G defines an exterior contact region 152A, an interior contact region 152B and intermediate contact regions 152C with the application wall 30. Each intermediate contact region 152C connects an interior contact region 152A and an exterior contact region 152B. The contact regions 152A to 152C thus define, around each orifice 82A, a closed contact line.

Thus, each contact region 152A, 152B extends over a portion of the circumference around the axis A-A', and not over the entire circumference.

The operation of the dispensing heads 16 described in FIGS. 21 to 23 is equivalent to the operation of the head 16 described in FIGS. 14 to 19.

Figure 25:
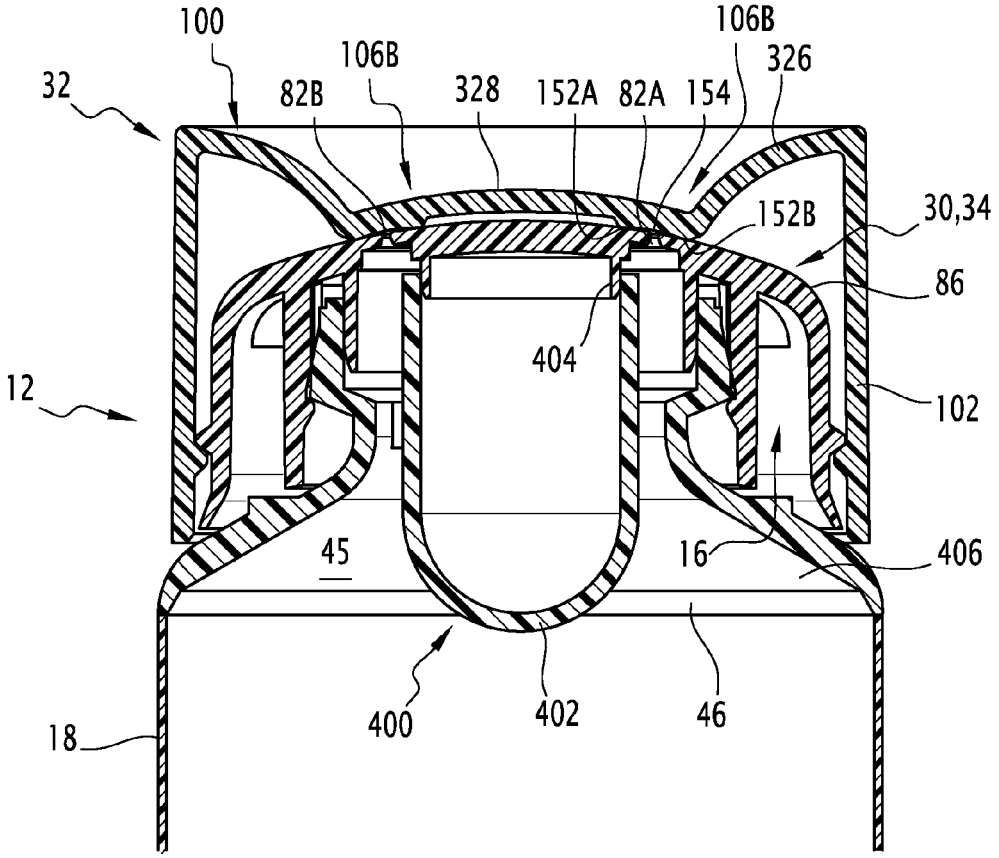
FIG. 25 is a view equivalent to that of FIG. 16 of an alternative of a dispensing head according to the invention.

An alternative of the head 16 according to the invention is shown in FIG. 25. In this alternative, the application wall 30 is formed directly on the support 34 in a single piece with the support 34.

In addition, the head 16 comprises a member 400 for reducing the dead volume inside the central product circulation passage 45. In this example, the member 400 is formed by a dome 402 projecting upward from the wall 30 in the central passage 45. The dome 402 is, in this case, attached to the wall 30 by means of an interior skirt 404 engaged in the dome 402. Alternatively, the member 400 is in a single piece with the wall 30 and/or with the support 34.

The dome 402 has a curved shape at its upstream end. It defines a circumferential space 406 for the passage of cosmetic product.

The presence of the member 400 limits the amount of product present in the head 16, in a location that cannot be compressed radially by the user. Thus, the volume of product contained in the container 12 that is not directly usable by a user is minimized.

Figure 26:
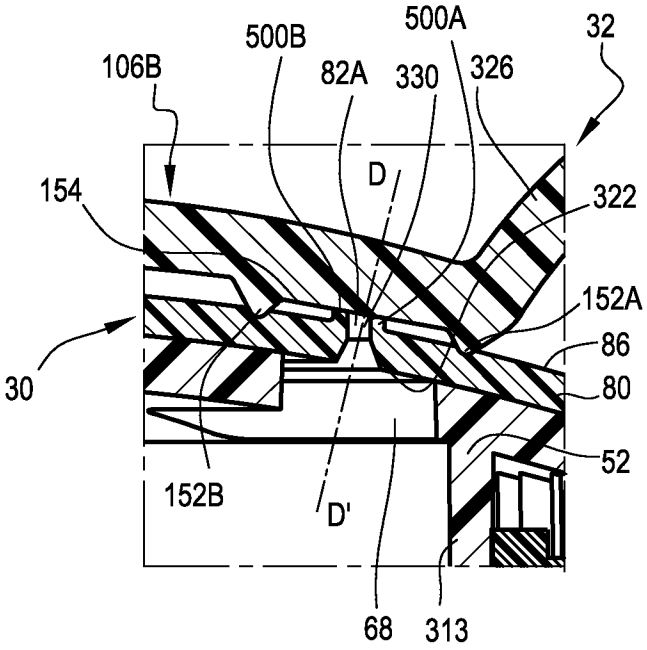
FIG. 26 is a detailed view equivalent to that of FIG. 25 of an alternative dispensing head according to the invention.

In the embodiment of FIG. 26, the application wall 30 of the head 16 has at least one additional contact protrusion 500A, 500B located advantageously along the lateral edge of each orifice 82A.

In this example, each protrusion 500A, 500B protrudes externally from the downstream surface 86. It is formed by an annular bead.

In the closing position of the cap 32, each protrusion 500A, 500B contacts a bearing element 1068.

At least one contact protrusion 500A, 500B has a closed countour 50 so as to ensure a peripheral seal.

In this example, the application wall 30 defines an exterior contact protrusion 500A and an interior contact protrusion 500B located respectively along opposite radial edges of the orifice 82A.

The contact protrusions 500A, 500B hence contact the bearing element 102B in the closed volume 330 defined between the regions of contact 152A, 152B.

When the cap 32 occupies its closing position, the bearing element 106B applies pressure on the application wall 30 in the contact regions 152A, 152B, since these regions 152A, 152B are located in register with the reinforcement 44.

The bearing element 106B applies a lower pressure on the contact protrusions 500A, 500B, and slightly bends the edges 322 of the application wall 30 located around the opening 68.

In a variation (not shown), the contact protrusions 500A, 500B form directly the first exterior contact region and the second interior contact region. No protrusion is provided on the bearing element 106B.

Figure 27:
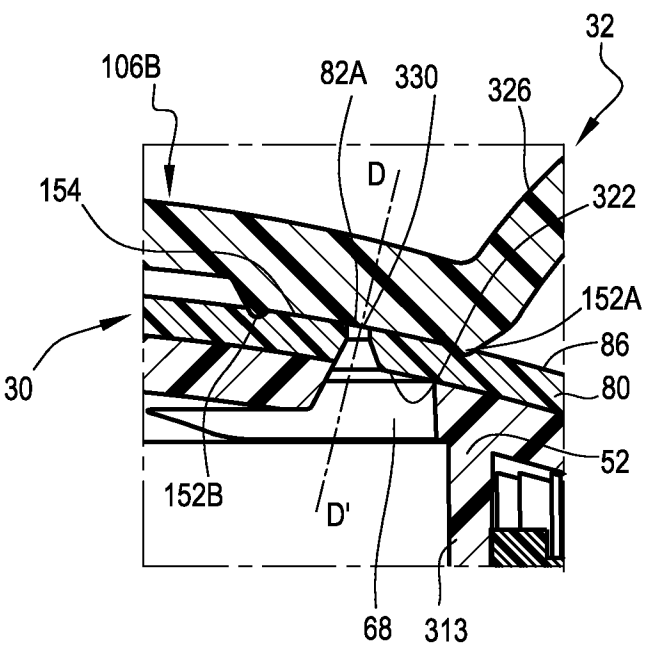
FIG. 27 is a detailed view equivalent to FIG. 26 of an alternative dispensing head according to the invention.

In the example of FIG. 27, the intermediate region 154 located between the first exterior contact region 152A and the second interior contact region 152B is also at least partially in contact with the downstream surface 86 of the application wall 30. The pressure applied by the first contact region 152A and by the second contact region 152B on the wall 30 is nevertheless higher than the pressure applied on the wall 30 by the intermediate region 154.

In another variation, the downstream surface 86 of the application wall is covered with a removable cover before its first use to close the dispensing orifices 82A.

Generally, in all of the embodiments, the total span of the orifices 82A is less than 20%, or even less than 10% of the total span of the downstream surface 86 of the application wall 30.

The invention claimed is:

1. Product dispensing head for a container, including:

an application wall having a central axis, in which the application wall defines at least one product dispensing orifice, off-centered with respect to the central axis, a removable cap, mobile with respect to the application wall between a position for closing each dispensing orifice and a product dispensing position, the removable cap comprising a bearing element on the cap, suitable for exerting a pressure on the application wall at a distance from the dispensing orifice when the cap occupies its closing position, in which the dispensing orifice remains clear when the bearing element is applied on the application wall, wherein, when the cap occupies its closing position, each dispensing orifice is placed facing an intermediate closed region of the bearing element, located between a first exterior contact region of the bearing element with the application wall and a second interior contact region of the bearing element with the application wall, wherein the first exterior contact region and the second interior contact region are separate with the second exterior contact region being contained inside the surface defined by the first interior contact region; the intermediate closed region between first exterior contact region and the second interior contact region is hollow; and each of the first exterior contact region and the second interior contact region protrudes from the hollow region.

2. Head according to claim 1, wherein at least one of the first region and the second region revolves about the central axis.

3. Head according to claim 2, wherein the first region and the second region are formed by contact lines, with the radial span of each region being less than 4 mm.

4. Head according to claim 2, wherein the dispensing orifice is formed by a slot, with a maximum radial span (er) less than its length.

5. Head according to claim 1, wherein the first region and the second region are connected to one another by intermediate contact regions of a bearing element on the cap, in which the first region, each intermediate contact region and the second region define a closed contact line surrounding a dispensing orifice.

6. Head according to claim 5, wherein the first region and the second region are formed by contact lines, with the radial span of each region being less than 4 mm.

7. Head according to claim 1, wherein the first region and the second region are formed by contact lines, with the radial span of each region being less than 4 mm.

8. Head according to claim 1, wherein the dispensing orifice is formed by an slot, with a maximum radial span (er) less than its length.

9. Head according to claim 1, wherein the maximum radial distance radially separating the dispensing orifice from the first region and the second region is less or equal to 5 mm.

10. Head according to claim 1, wherein the maximum radial distance separating the first region from the second region is greater than 0.5 mm.

11. Head according to claim 1, wherein the application wall has a central area without an orifice delimited externally by the second region and through which the central axis (A-A') passes.

12. Head according to claim 1, wherein the application wall has a downstream surface without roughnesses or macroscopic projections.

13. Head according to claim 1, wherein each bearing element is more rigid than the application wall, with the application wall being locally deformable in the vicinity of the dispensing orifice, on each side of the dispensing orifice.

14. Head according to claim 1, wherein the application wall is more rigid than the bearing element, with each bearing element being locally deformable in the vicinity of the dispensing orifice on each side of the dispensing orifice.

15. Head according to claim 1, wherein the application wall is formed by a thermoplastic elastomer.

16. Head according to claim 1, which comprises a support holding or defining the application wall, in which the cap is capable of being screwed or snapped onto the support.

17. Head according to claim 1, wherein the application wall defines a plurality of separate dispensing orifices, in which each dispensing orifice is located between a first exterior contact region of the bearing element and a second interior contact region of a bearing element.

18. Product dispensing device, which comprises:

a container;

a dispensing head according to claim 1, closing the container.

19. Device according to claim 18, wherein the container is formed by a flexible tube or by a tube containing a dispensing mechanism.

20. Head according to claim 1, wherein the first region and the second region are formed by contact lines, with the radial span of each region being between 0.2mm and 2 mm.

* * * * *